United States Patent [19]

Gerlach et al.

[11] 4,245,379

[45] Jan. 20, 1981

[54] METHOD OF FABRICATION OF FLAT GRIDS OF PYROLITIC GRAPHITE FOR ELECTRON TUBES

[75] Inventors: Pierre Gerlach; Roger Hoet, both of Paris, France

[73] Assignee: Thomson-CSF, Paris, France

[21] Appl. No.: 76,864

[22] Filed: Sep. 19, 1979

[30] Foreign Application Priority Data

Sep. 19, 1978 [FR] France ..... 78 26818

[51] Int. Cl.[3] ..... H01J 9/14

[52] U.S. Cl. ..... 29/25.18

[58] Field of Search ..... 29/25.18, 25.17

[56] References Cited

U.S. PATENT DOCUMENTS

| | | | |
|---|---|---|---|
| 3,535,758 | 10/1970 | Hoet | 29/25.18 |
| 4,020,535 | 5/1977 | Cuneo et al. | 29/25.18 |

*Primary Examiner*—Richard B. Lazarus

*Attorney, Agent, or Firm*—Roland Plottel

[57] ABSTRACT

A flat grid of pyrolytic graphite is obtained by cutting a disc from a cylindrical blank followed by deformation under pressure and by means of a partial vacuum. The grid is then machined and stretched within a stressing frame which also serves to mount the grid within the electron tube.

2 Claims, 4 Drawing Figures

METHOD OF FABRICATION OF FLAT GRIDS OF PYROLITIC GRAPHITE FOR ELECTRON TUBES

Figure 1:
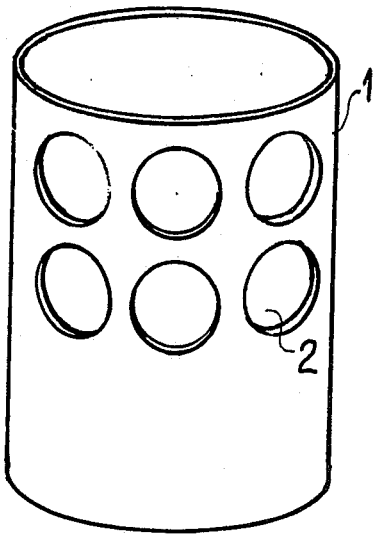

This invention relates to electron tubes of the flat electrode type comprising at least one grid of pyrolytic graphite.

A grid of this type usually consists of one or a number of sheets of thin wires limited by an edge portion of substantial thickness, said wires being parallel to each other or interlaced so as to form meshes.

In more exact terms, the invention is directed to a method of fabrication of a flat grid of pyrolytic graphite.

The advantages offered by the use of grids of pyrolytic graphite (also known as oriented graphite) are now well known. They have been described in particular in a number of patents filed by the present Applicant, and especially in U.S. Pats. No. 3,307,063 and No. 3,535,758.

In a number of different patents and patent Applications, the present Applicant has also described methods for the fabrication of grids of pyrolytic graphite of cylindrical shape by direct epitaxial growth on a hot mandrel, thus solving the particular problems attached to the use of pyrolytic graphite.

However, attempts made up to the present time to employ flat electrodes of pyrolytic graphite prepared by direct epitaxial growth in the same manner as the grids mentioned above have always proved unsuccessful by reason of the stresses which arise during cooling of the graphite deposit. These stresses result from the thermal anisotropy of pyrolytic graphite and remain after cooling within the plate which is thus obtained and employed as electrode. Thus a graphite plate which was initially flat at 2000° C. becomes curved at 20° C.

The solution which consists in machining a flat element in the plate which has become curved must be dismissed as a practical possibility. During operation and in spite of the prestress applied to the wires constituting the grid, the element which is placed at room temperature undergoes further deformation which is liable to produce a grid-cathode short-circuit when it is mounted within a tube since the width of the grid-cathode space of a tube of the flat electrode type is no more than a few hundredths of a millimeter.

This problem is solved by adopting a method for obtaining a flat grid in accordance with the invention, which essentially consists in preparing the grid from a cylindrical blank of pyrolytic graphite (the blank itself being prepared, for example, in accordance with the teachings of U.S. Pat. No. 3,535,758) by carrying out the following operations:

precision machining of the cylindrical blank in order to bring this latter to the thickness adopted for the final flat grid;

cutting-out discs by sand jet process (or any process which does not subject discs to machining stresses) from the cylindrical blank;

deformation of the discs obtained by pressure or partial vacuum;

if necessary, final trueing by grinding of the flat elements previously obtained;

formation of the wire lattice by sand-jet process (or any other process which does not give rise to machining stresses) ;

mounting of the grid in a metallic stressing frame, taking into account the direction of initial curvature of the grid so as to ensure that the concave side of said grid is directed towards the cathode of the electron tube.

Figure 2:
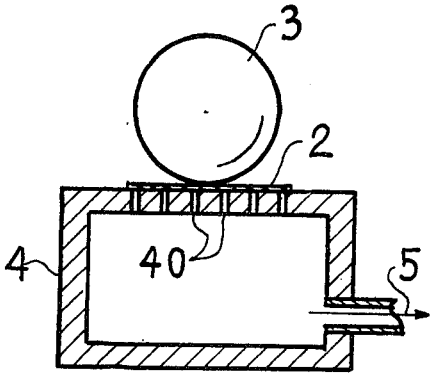
Figure 3:
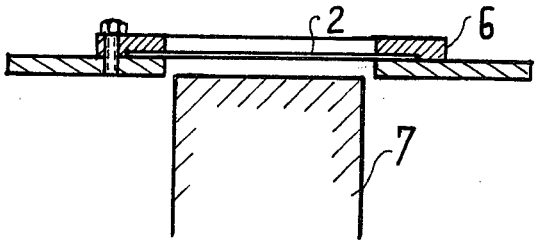

A more complete understanding of the invention will be gained from the following description and from the accompanying drawings, in which:

FIGS. 1, 2 and 3 illustrate different stages of the method in accordance with the invention;

FIGS. 4*a* and 4*b* are sectional views of the grid obtained in accordance with the invention and placed within an electron tube.

There is shown at 1 in FIG. 1 a cylindrical starting workpiece or blank of pyrolytic graphite of large diameter (200 mm, for example). Elements 2 (of circular shape, for example, and 20 mm in diameter) are cut out of said workpiece, preferably by sand jet process in order to prevent the generation of parasitic stresses, each element being intended to be converted into a flat grid. The elements 2 thus obtained are obviously curved but only in one plane at right angle to the axis of the blank, whereas this is not the case when starting from a workpiece consisting of a flat blank at high temperature and obtained by direct plane epitaxy. In this case the cooled elements are usually curved in a number of different planes.

The elements 2 which are initially curved in a single plane are converted to flat elements as shown in FIG. 2 by simultaneous action of a pressure exerted on the element by a grinding-wheel 3 and of a partial vacuum : the element 2 is applied against and held in position on the top wall of a vacuum chamber 4 (shown in the figure in diagrammatic cross-section along a vertical plane), said top wall being either porous or pierced by holes 40 of small diameter. A vacuum is maintained within said chamber by means of a pump represented diagrammatically by the arrow 5. The device for flattening the element 2 is shown only in very diagrammatic form since it does not in itself constitute an object of the invention and its constructional design comes within the field of conventional practice. In fact, any known arrangement having the same effect could in any case be substituted for the device shown in the figure. The flattened element 2 which is obtained at the end of the stage illustrated in FIG. 2 is subsequently ground if necessary, whereupon the element is machined by the sand jet process in order to have the appearance of a grid formed of wires; the grid thus obtained is clamped within a metallic stressing frame 6 as shown in FIG. 3. Thus, while serving to stretch the grid, said frame also serves as a support for mounting said grid within the tube, only part of the tube cathode 7 being shown in this figure. During operation, the frame aforementioned is usually at a temperature of considerably lower value than that of the wires of the grid.

Figure 4:
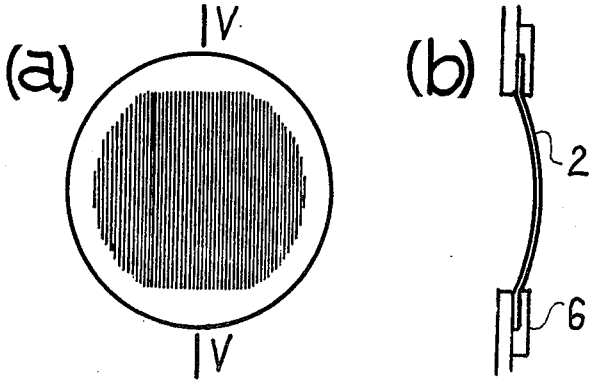

FIG. 4(*a*) is a bottom view (in the arrangement of FIG. 3 in which the grid is placed above the cathode). FIG. 4(*b*) is a vertical sectional view along line V—V and clearly shows the assembly of the grid. The assembly operation is carried out in such a manner as to ensure that any deformation of the grid in the direction of initial curvature of the blank from which it has been cut (for the sake of enhanced clarity, this sectional view is a fictitious representation of the grid in its initially curved state although it is actually flat at this stage of preparation) has a tendency to move the grid away from the cathode (namely in the upward direction in the arrangement of FIG. 2).

The numerical indications given earlier only have the value of examples which are given without any limitation being implied. However, it does appear to be clearly desirable to have a ratio $\phi_1/\phi_2$ (ratio of the diameter $\phi_1$ of the blank to the diameter $\phi_2$ or large transverse dimension of the flat element cut from said blank) which is as high as possible since relative variations liable to affect the grid-cathode space as a result of a grid deformation are in inverse ratio to $\phi_1$, $\phi_2$.

These grids find an application in all electron tubes of the flat cathode type and especially high-power tubes in particular for the construction of control electrodes for cathode circuit assemblies.

What is claimed is:

1. A method of fabrication of a flat grid of pyrolytic graphite for an electron tube, wherein said method involves the following successive operations:

preparation of a cylindrical blank of pyrolytic graphite by epitaxial growth on a hot mandrel;

precision machining of the cylindrical blank in order to bring said blank to the thickness of the final flat grid;

cutting of a disc to the dimension of the grid, said disc being cut out of said blank;

flattening of the cut-out disc by applying a pressure on one face of said disc;

if necessary a final trueing operation by grinding the flat disc obtained as a result of the previous operation;

machining of the disc by any known means such as the sand-jet process in order to produce a network of thin wires defining openings between said wires, said network being formed within an edge portion of relatively greater thickness;

mounting of the grid in extension within a stressing frame.

2. A method according to claim 1, wherein the other face of the disc is in communication with a vacuum chamber during the flattening operation.

* * * * *